US008091708B2

(12) United States Patent
Loftin et al.

(10) Patent No.: US 8,091,708 B2
(45) Date of Patent: Jan. 10, 2012

(54) CHILD RESISTANT BLISTER PACKAGE HOUSING WITH REMOVABLE TAB STRIPS

(75) Inventors: Caleb S. Loftin, Richmond, VA (US); William Rigby, Spring Hope, NC (US)

(73) Assignee: MeadWestvaco Corporation, Richmond, VA (US)

( * ) Notice: Subject to any disclaimer, the term of this patent is extended or adjusted under 35 U.S.C. 154(b) by 84 days.

(21) Appl. No.: 12/262,770

(22) Filed: Oct. 31, 2008

(65) Prior Publication Data

US 2010/0108677 A1 May 6, 2010

Related U.S. Application Data

(60) Provisional application No. 60/984,274, filed on Oct. 31, 2007.

(51) Int. Cl.
*B65D 83/04* (2006.01)
*B65D 50/14* (2006.01)

(52) U.S. Cl. ..... 206/531; 206/532; 206/528

(58) Field of Classification Search ..... 206/528, 206/531, 532, 538, 828, 462, 461, 534.1
See application file for complete search history.

(56) References Cited

U.S. PATENT DOCUMENTS

| | | | | |
|---|---|---|---|---|
| 5,091,261 | A | 2/1992 | Casey | |
| 5,172,812 | A * | 12/1992 | Wharton et al. | 206/531 |
| 5,325,968 | A * | 7/1994 | Sowden | 206/532 |
| 5,339,960 | A * | 8/1994 | Price | 206/531 |
| 5,758,774 | A * | 6/1998 | Leblong | 206/531 |
| 5,927,500 | A | 7/1999 | Godfrey et al. | |
| 6,010,784 | A | 1/2000 | Peterson | |
| 6,338,407 | B2 | 1/2002 | Danville | |
| 7,051,876 | B2 | 5/2006 | Grosskopf | |
| 7,144,635 | B2 | 12/2006 | Hawes | |
| 7,401,702 | B2 * | 7/2008 | Hession | 206/531 |
| 7,726,486 | B2 | 6/2010 | Jones | |
| 2003/0234203 | A1 | 12/2003 | Urban et al. | |
| 2004/0188312 | A1 * | 9/2004 | Stepowany | 206/531 |
| 2007/0084747 | A1 * | 4/2007 | Gherdan et al. | 206/531 |
| 2007/0221534 | A1 | 9/2007 | Intini | |
| 2009/0288978 | A1 | 11/2009 | Prud'Homme | |
| 2009/0308775 | A1 | 12/2009 | Hession et al. | |

FOREIGN PATENT DOCUMENTS

EP 0847921 6/1998

* cited by examiner

*Primary Examiner* — Steven A. Reynolds
(74) *Attorney, Agent, or Firm* — MWV Intellectual Property Group

(57) ABSTRACT

A child resistant product package includes a first panel, a second panel, a tab strip insert, and a blister package. The first panel incorporates at least one blister aperture and at least one tab strip access pad. The second panel includes at least one product access aperture and at least one tab strip grasping pad. The tab strip insert has at least one tab strip. The first panel and the second panel are fastened together. Once fastened together, the first panel and the second panel collectively form a housing for the tab strip insert and the blister package.

10 Claims, 6 Drawing Sheets

CHILD RESISTANT BLISTER PACKAGE HOUSING WITH REMOVABLE TAB STRIPS

This application claims the benefit of Provisional Application No. 60/984,274, filed Oct. 31, 2007.

TECHNICAL FIELD

The present disclosure relates generally to child resistant blister packaging for the packaging and dispensing of articles. More specifically, the present disclosure is directed to a package including a child resistant blister package housing with removable tab strips for encapsulating one or more blister packages and allowing controlled and child-resistant packaging and dispensing of articles.

BACKGROUND

It is known that blister packaging can be used to store and deliver a wide range of items. Among the many types of items that can be stored and delivered in blister packs are pharmaceutical products, such as tablets, pills, capsules, and other related items. Conventional blister packages include a blister tray that is typically a thermoformed plastic sheet with a plurality of blister cells or depressions formed therein. Typically, after items are placed in the cells, the items are retained and protected in the respective cells by securing a backing sheet to the blister tray. The backing sheet is often a thin layer of metal foil, plastic, paperboard, or other material secured to the back of the blister tray, thereby sealing the cells. In other types of blister packages, the contents are placed in substantially puncture-proof foil containers that can be covered with foil or paperboard backing.

In many blister packages, the foil backing is thin enough to be punctured mechanically, or ruptured by pressing the blister so that the encapsulated item penetrates the foil backing. If the backing sheet is made from, for example, paperboard, or similar material, then the backing often includes gates in the backing sheet that covers the openings of respective blister cells. In practice, each gate is deformed or manipulated so that it ruptures or partially separates from the surrounding paperboard to allow the item contained within the blister cell to be pushed out of the blister cell for use.

While the conventional blister packaging is viewed by many to be suitable for most applications, there are several design deficiencies. The conventional packages provide removal of the items from the blister cells, but offer little in the way of resisting child tampering. Child resistance is a feature that is desired, particularly for dose pharmaceutical packaging.

To address the desirability of child resistance, many blister packaging designs employ materials of increased rigidity, compared to conventional non-child-resistant packages. For example, in increased-rigidity packages, the backing sheet and/or the blister cells can be made thicker and/or more resistant to pressure. As such, a young child is unlikely to be able to generate the pressure required to force the package contents through the increased-strength materials. In addition to the benefits in terms of child-resistance, increased rigidity can provide additional protection for the enclosed materials, which may be, as is the case with pharmaceuticals, fragile and susceptible to breakage.

DESCRIPTION

As required, detailed embodiments of the present disclosure are disclosed herein. It must be understood that the disclosed embodiments are merely exemplary of the disclosure that may be embodied in various and alternative forms, and combinations thereof. As used herein, the word "exemplary" is used expansively to refer to embodiments that serve as an illustration, specimen, model or pattern. As used herein, the terms "foldable score line" and "severance line" refer to all manner of lines indicating optimal fold or cut locations, frangible or otherwise weakened lines, perforations, a line of perforations, a line of short slits, a line of half-cuts, a single half-cut, a cut line, scored lines, slits, any combination thereof, and the like.

The figures are not necessarily to scale and some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

It is contemplated that the present disclosure is not limited to the pharmaceutical and personal healthcare related articles referenced with the illustrated embodiment. Instead, embodiments of packaging made in accordance with the present disclosure can have application in packaging for any small, delicate, sensitive, or portable article. Furthermore, the packaging can be used for larger items as a method of decreasing the incidence of product theft. Examples of articles for which such packaging can be employed include all manner of consumable products such as candy, food, vitamins, tobacco, and the like; all manner of personal care products such as contact lens, birth control devices, smoking cessation patches, hearing aid batteries, and the like; as well as any item that can fit within a portable container.

Figure 1:
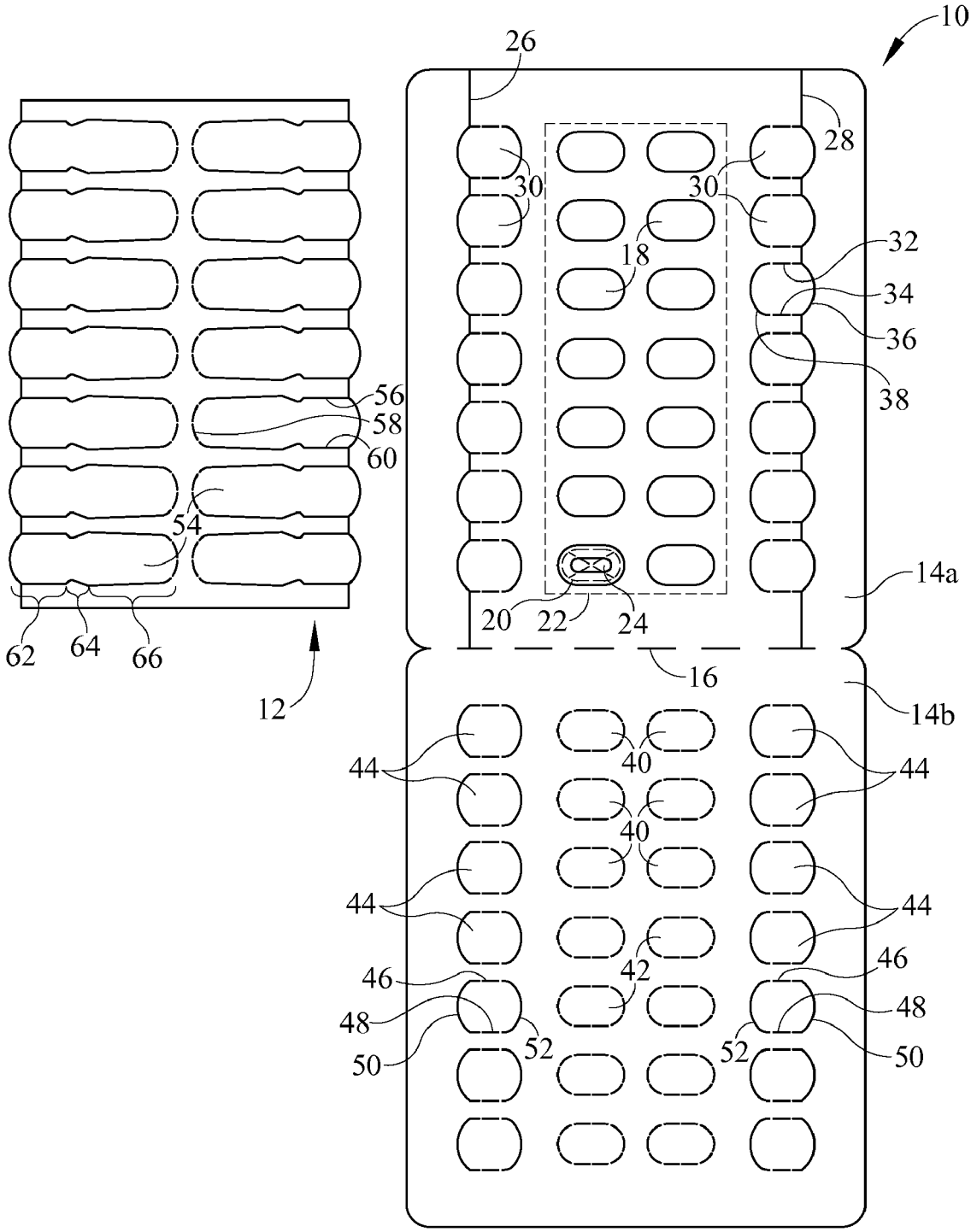
FIG. 1 is a plan view of an exemplary packaging blank and tab strip insert, according to an exemplary embodiment of the present disclosure.

Referring now to the drawings, wherein like elements are represented by like numerals, and wherein like articles and respective elements are, at times, represented by primed numerals, FIG. 1 is a plan view of an exemplary packaging blank 10 and a tab strip insert 12 made according to the present disclosure.

The packaging blank 10 includes a face panel 14*a* and a back panel 14*b*. The face panel 14*a* and the back panel 14*b* are hingedly connected along a foldable score line 16. Although, in this exemplary embodiment, the panels 14*a*, 14*b* are illustrated as integrally formed as one piece, it should be understood that the respective panels 14*a*, 14*b* can be formed as two separate and distinct pieces.

The packaging blank 10 and the tab strip insert 12 can be constructed from any suitable substrate material. Suitable substrate materials include, but are not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from MeadWestvaco Corporation. Additionally, it is contemplated that embodiments of the present disclosure may be used in conjunction with NATRALOCK® packaging material. Additionally, a tear-resistant layer may or may not be adhered to the packaging blank 10 and/or the tab strip insert 12. Tear-resistant layers, if included, are often laminated to the blank before cutting. Even if no tear-resistant layers are included as part of the packaging blank 10 and/or the tab strip insert 12, the packaging blank and/or a package made from the packaging blank 10 and/or tab strip insert 12 may be augmented by tear resistant materials such as, but not limited to, tear resistant tapes, labels, glues, coating, combinations thereof, or the like. Furthermore, it is possible, and in fact contemplated, that an adhesive layer or material may be added to the packaging blank 10 and/or the tab strip insert 12 prior to assembling the packaging blank 10 and the tab strip insert 12 into a package, as will be explained below. The packaging blank 10 and/or the tab strip insert 12 may also be an unbleached board, depending on the desired appearance of the final package.

The face panel 14*a* can further include one or more blister apertures 18. The blister apertures 18 are shaped and dimensioned to receive the blisters 20 of a blister pack 22. As illustrated, one or more blisters 20 can contain a product 24, illustrated in FIG. 1 as a capsule of medication. The face panel 14*a* can further include bending lines 26 and 28. The bending lines 26 and 28 can be interrupted by one or more tab strip access pads 30. The tab strip access pads 30 can be defined by severance lines 32 and 34, and cut lines 36 and 38.

The back panel 14*b* includes one or more product access apertures 40. The product access apertures 40 are defined by severance lines 42. The severance lines 42 can be shaped and dimensioned to allow the packaged product to pass therethrough, after or during removal of the material defined by the severance lines 42, by interfacing with and/or receiving a tool or a force from the product itself in a method that will be described below with reference to FIG. 3. The back panel 14*b* further includes one or more tab strip grasping pads 44. The tab strip grasping pads 44 can be defined by severance lines 46 and 48, and cut lines 50 and 52. The tab strip grasping pads 44 can align with and cooperate with the tab strip access pads 30 of the face panel 14*a*. It should be understood that the tab strip access pads 30 and the tab strip grasping pads 44 can have any desired shape and dimensions.

The tab strip insert 12 can include one or more tab strips 54. The tab strips 54 can be defined by severance lines 56, 58, and 60. As illustrated, the tab strips 54 can include various features. In FIG. 1, these features are illustrated by assigning regions to the tab strips 54 in accordance with the general purpose of that region. A tab strip 54 can include a grasping region 62, a tamper safety region 64, and a product access prevention region 66.

The grasping region 62 of a tab strip 54 can be shaped and dimensioned substantially similar to the tab strip access pads 30 of the face panel 14*a*, and the tab strip grasping pads 44 of the back panel 14*b*. When the tab strip insert 12 is assembled with the packaging blank 10, the grasping region 62 of the tab strips 54 can align with and cooperate with the tab strip access pads 30 of the face panel 14*a*, and the tab stress grasping pads 44 of the back panel 14*b*.

The tamper safety region 64 of a tab strip 54 is included to increase the tamper-resistance of the tab strips 54, as will be explained below with respect to FIG. 2. In the illustrated embodiment, the tamper safety region 64 is formed by narrowing the tab strip 54 in the area adjacent the grasping region 62. The purpose of the tamper safety region 64 is illustrated and described below with respect to FIGS. 3 and 4.

The product access prevention region 66 is designed to further impede unauthorized access to the product 24 in a blister pack 22. The product access region 66 aligns with and cooperates with the product access apertures 40 of the back panel 14*b* and the blisters 20. This function of the tab strips 54 is illustrated and described below with respect to FIGS. 3 and 4.

Figure 2:
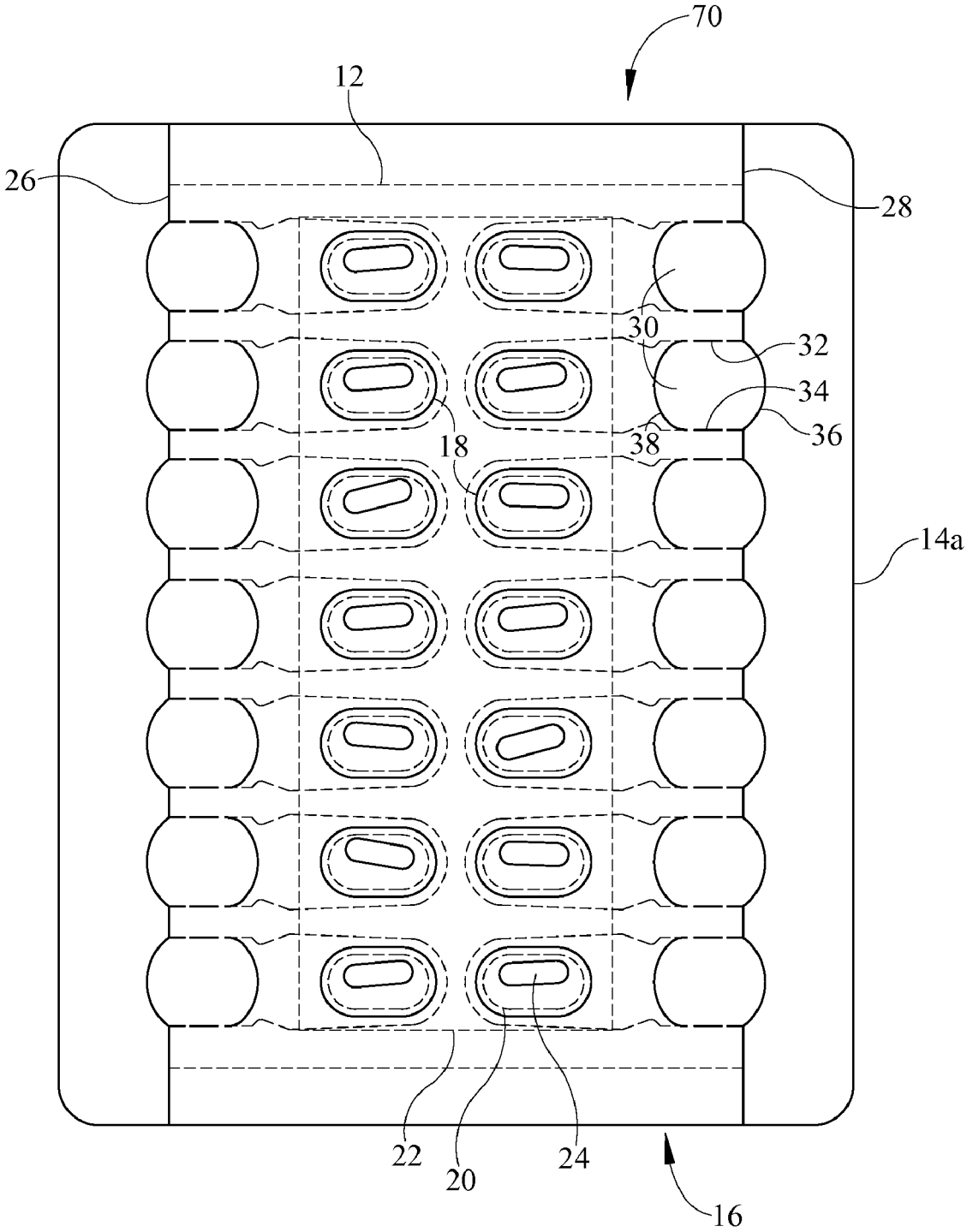
FIG. 2 is a plan view of an exemplary package, made from the packaging blank and tab strip insert of FIG. 1.
Figure 3:
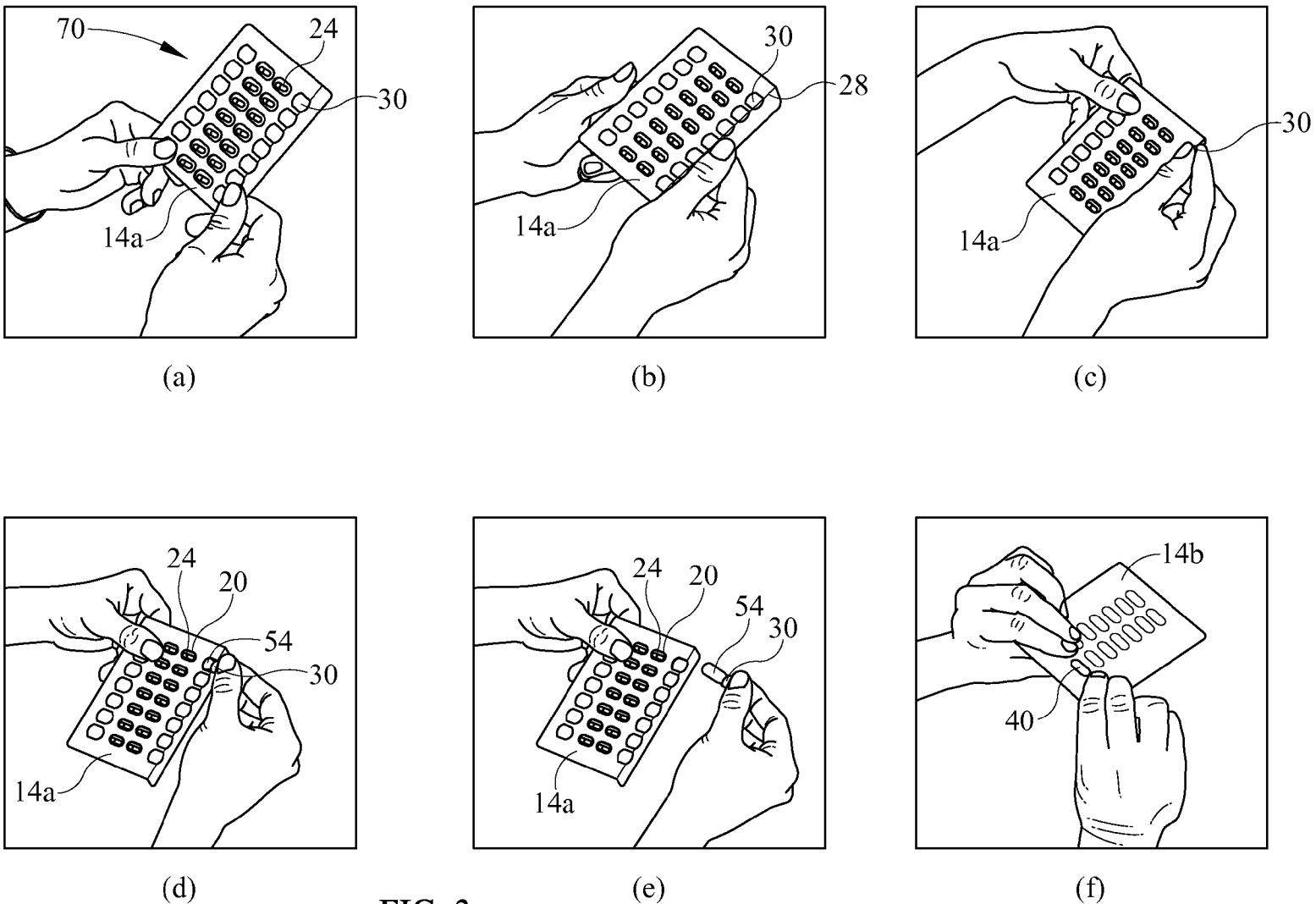
FIG. 3 illustrates a method for accessing products packaged in the exemplary package of FIG. 2.

With additional reference now to FIGS. 2-3, a package 70, made from the packaging blank 10 and the tab strip insert 12, is shown. A package 70 is formed by inserting the blisters 24 of a blister pack 22 into respective blister apertures 18, such that the blisters 24 protrude from the face panel 14*a*. After the blister pack 22 is in position, the tab strip insert 12 can be placed into position. To place the tab strip insert 12 into position, the grasping portions 62 of the tab strips 54 can be aligned with the tab strip access pads 30 of the face panel 14*a*. Similarly, the product access prevention regions 66 of the tab strips 54 can be aligned with the blister apertures 18 of the face panel 14*a*. After the tab strip insert 12 is in position, the face panel 14*a* and the back panel 14*b* of the blank 10 can be folded into a face contacting arrangement, and secured. To fold the blank 10, the facing surfaces of the face panel 14*a* and the back panel 14*b* are brought toward each other by folding along foldable score line 16. In completing the folding step, the tab strips 54 are aligned with respective blister apertures 18, and thereby with blisters 20 of blister pack 22. Likewise, as mentioned above, the tab strip access pads 30 of the face panel 14*a* and the tab strip grasping pads 44 of the back panel 14*b* can be aligned with each other, and with the tab strip grasping regions 62. The face panel 14*b* and the back panel 14*a* can be secured to one another and to the tab strip insert 12. Additionally, one or more blister packs 22 can be held in place, using any desired means or methods.

In practice, to access an item 24 from a package 70, a user bends the package 70 along one of the bending lines 26, 28. If the user is looking at the face panel 14*a*, then the package portion between the bending line 26, 28 and the edge of the package 70 is bent away from the user, as shown in FIG. 3. After the package is bent, the tab strip access pads 30 will generally be accessible. As illustrated, the tab strip access pads 30 can be joined to respective grasping regions 62 of the tab strips 54, and tab strip grasping pads 44 of the back panel 14*b*. The user can grasp the tab strip access pads 30, and any other material joined thereto, and lift the material, i.e., apply a force to the material that pulls a tab strip access pad 30 toward the user if the user is looking at the face panel 14*a*. By applying this force to a tab strip access pad 30, and any material joined thereto, the user can sever the perforations of severance lines 32 and 34 that partially define the tab strip access pads 30. As illustrated, this force can also sever the perforations of severance lines 46 and 48, which partially define the tab strip grasping pads 44, if the tab strip grasping pads 44 are aligned with the tab strip access pads 30, as illustrated.

Once the perforations of the severance lines 32, 34, 46, and 48 are severed, the tab strip 54 can be pulled out of the package 70. The tab strip 54 may be pulled out of the package 70 by withdrawing laterally the tab strip 54 and sliding the tab strip 54 out from between the face panel 14*a* and back panel 14*b*, approximately through the area formed by removing the tab strip access panel 30.

After the tab strip 54 is removed, the product 24 is more easily removable by applying a force to the top of the blister 20 behind which the tab strip 54 has been removed. As a force is applied to the blister 20, the product 24 can be pushed through the backsheeting of the blister pack 22, and into the product access aperture 40, defined by a severance line 42. The applied force must be sufficient to sever the perforations of severance line 42, after which the product 24 can exit the package 70 through the product access aperture 40.

Figure 4:
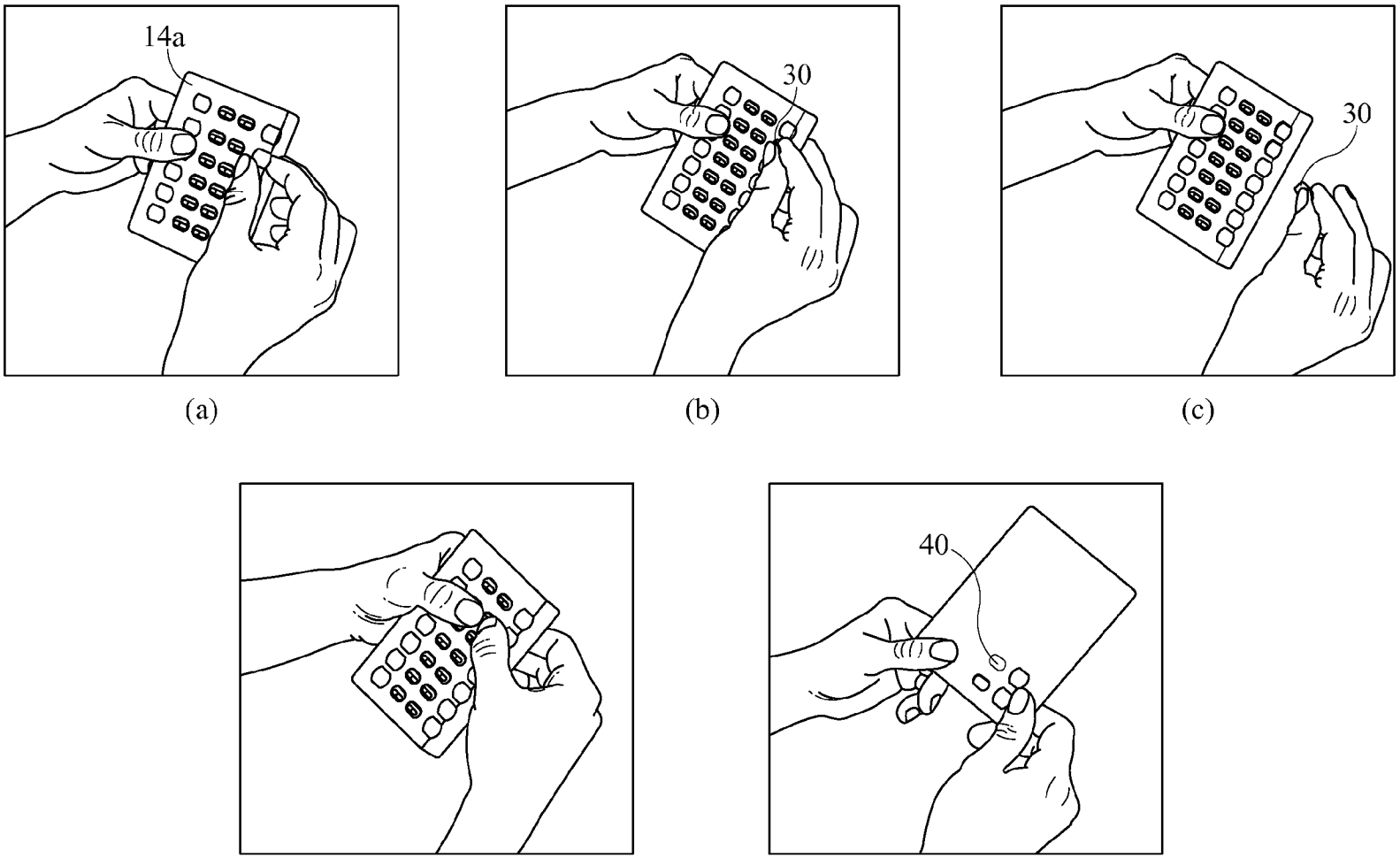
FIG. 4 illustrates an additional child resistance feature of the exemplary package of FIG. 2.

Turning now to FIG. 4, an additional safety feature of the package 70 is illustrated. As explained above, the tamper safety region 64 can increase the tamper resistance of the package 70. As illustrated in FIG. 4, if a skewed force is applied to a tab strip access panel 30, then the grasping region 62 of the tab strip 54 that is joined to the tab strip access panel 30 may be severed from the product access prevention region 66 of that tab strip 54, making removal of the tab strip 54 from the package 70 difficult, if not impossible. If the product access prevention region 66 of the tab strip 54 remains in the package 70, then it may be difficult, if not impossible, to push the product 24 out of the package in the intended manner. This feature can add an additional layer of tamper prevention and/or child resistance to the package 70.

Figure 5:
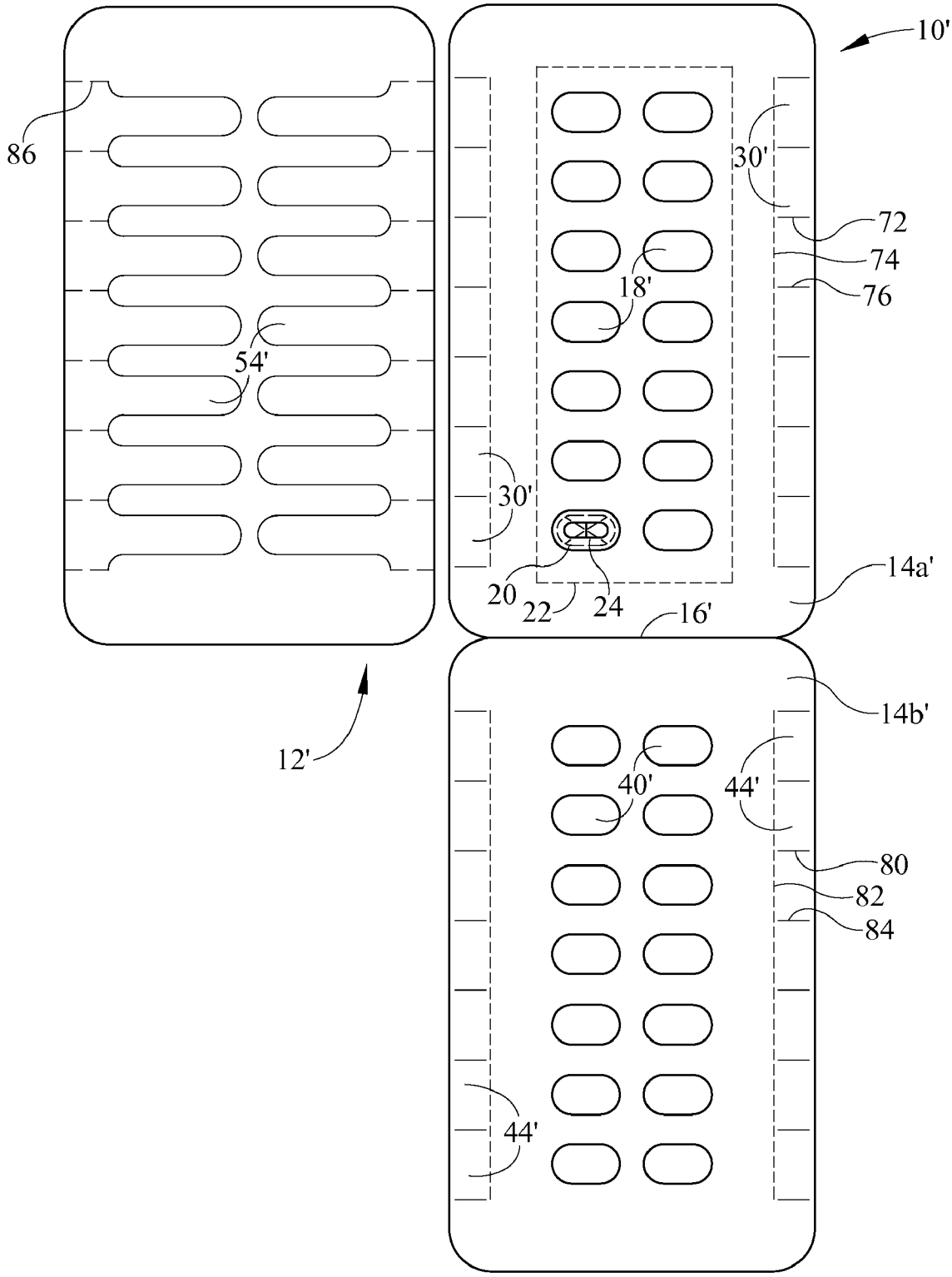
FIG. 5 is a plan view of an exemplary packaging blank and tab strip insert, according to an alternative embodiment of the present disclosure.

Referring now to FIG. 5, an alternative design for a packaging blank 10' and a tab strip insert 12' is illustrated. In FIG. 5, primed numerals are used to denote features that can have similar structure, design, and/or purpose as the features denoted by unprimed numerals in FIGS. 1-4.

The packaging blank 10' includes a face panel 14*a*', and a back panel 14*b*'. The panels 14*a*', 14*b*' are hingedly connected along a foldable score line 16'. Although in this exemplary embodiment, the panels 14*a*', 14*b*' are illustrated as integrally formed as one piece, it should be understood that the respective panels 14*a*', 14*b*' can be formed as two separate and distinct pieces.

The face panel 14*a*' can include one or more blister apertures 18'. The blister apertures 18' can be shaped and dimensioned to receive the blisters 20 of a blister pack 22. As illustrated, one or more blisters 20 can contain a product 24, illustrated in FIG. 5 as a capsule of medication. The face panel 14*a*' can also include one more tab strip access pads 30'. The tab strip access pads 30' can be defined by severance lines 72, 74, and 76.

As illustrated in FIG. 5, the back panel 14*b*' can be substantially identical to the face panel 14*a*'. Hence, though the features of the back panel 14*b*' are given different names and different reference numerals, relative to the face panel 14*a*', it should be understood that the determination as to which panel is the face panel 14*a*' and which panel is the back panel 14*b*' can be determined solely by orientation of the packaging blank 10'.

The back panel 14*b*' can include one or more product access apertures 40'. The product access apertures 40' be shaped and dimensioned to allow the packaged product to pass therethrough. As explained above, the product access apertures 40' can have the same shape and dimensions as the blister apertures 18' of the face panel 14*a*'. The back panel 14*b* can further include one or more tab strip grasping pads 44'. The tab strip grasping pads 44' can be defined by severance lines 80, 82, and 84. The tab strip grasping pads 44' can align with and cooperate with the tab strip access pads 30' of the face panel 14*a*'. It should be understood that the tab strip access pads 30' and the tab strip grasping pads 44' can have any desired shape and dimensions.

The tab strip insert 12' can include one or more tab strips 54'. The tab strips 54' can be defined by severance lines 86. As illustrated in FIG. 5, the severance lines 86 can have any desired features. For example, some or all of a severance line 86 can be replaced with a cut line. Additionally, or in the alternative, the number of perforations along a severance line 86 can be increased or decreased to make severance of a tab strip 54' from the tab strip insert 12' more or less difficult. This may be useful when tailoring the tab strip insert 12' for a desired purpose. Although not illustrated in FIG. 5, it should be understood that the tab strips 54' can include a tamper safety region that is substantially similar in function to the tamper safety region 64 of the tab strips 54 illustrated in FIGS. 1-4.

Figure 6:
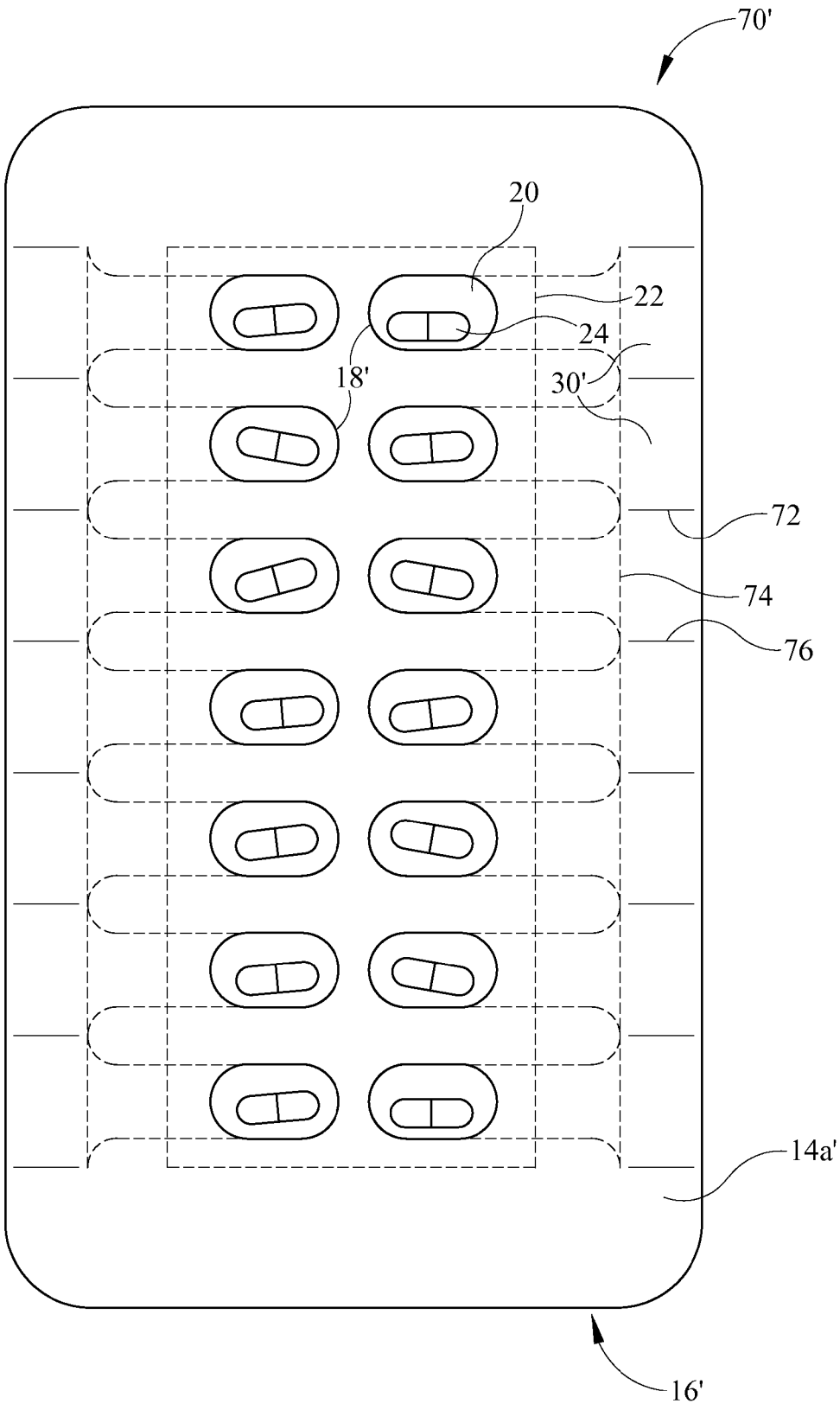
FIG. 6 is a plan view of an exemplary package, made from the packaging blank and tab strip insert of FIG. 5.

With additional reference now to FIG. 6, a package 70', made from packaging blank 10' and tab strip insert 12', is shown. A package 70' can be formed by inserting the blisters 20 of a blister pack 22 into respective blister apertures 18', such that the blisters 20 protrude from the face panel 14*a*'. After the blister pack 22 is in position, the tab strip insert 12' can be aligned with the blisters 20 of the blister pack 22. It should be understood that the dimensions of the tab strip insert 12', as illustrated, are substantially identical to the dimensions of the face panel 14*a*' and the back panel 14*b*'. Therefore, the tab strips 54' of the tab strip insert 12' line up with the tap strip access pads access pads 30', the tab strip grasping pads 44', and the blister apertures 18'. After the tab strip insert 12' is in position, the blank 10' can be folded into a face contacting arrangement, and secured. To fold the blank 10', the facing surfaces of the face panel 14*a*' and the back panel 14*b*' are brought toward each other by folding along foldable score line 16'. After completing the folding step, the tab strips 54' are aligned with respective blister apertures 18', and thereby with blisters 20 of blister pack 22. The face panel 14*a*' and the back panel 14*b*' can be secured to one another and/or to the tab strip insert 12', and the blister pack 22 can thereby be held in place, using any desired means or methods.

In practice, to access an item 54 from a package 70', upward pressure, i.e., a pressure that pulls away from the face panel 14*a*' and the back panel 14*b*', is applied to a tab strip access pad 30'. When such a force is applied to the tab strip access pad 30', the perforations of the severance lines 72, 74 and 76 are severed, thereby severing the tab strip access pad 30' from the surrounding material of the face panel 14*a*'. Additionally, this force can sever the perforations of the severance line 86 of the tab strip insert 12', and the severance lines 80, 82, and 84 of the back panel 14*b*'. After the perforations of severance lines 72, 74, 76, 86, 82, and 84 are severed, the tab strip 54' can be pulled out of the package 70', similar to the tab strip 54 of FIGS. 1-4. After the tab strip 54' is pulled out of the package 70', the product access apertures 40' are unobstructed by additional material. Once an adequate force is applied to a blister 20, the product 24 ruptures or tears through the backsheeting of the blister pack 22, and the product 24 can pass out of the package 70' through the product access aperture 40'

It should be understood that while the product access apertures 40' of FIG. 5 are illustrated as substantially similar to blister apertures 18', the product access apertures 40' can be defined by a severance line, thereby requiring the removal of material before a product 24 can pass therethrough.

While only one blister pack 22 is illustrated in the figures, it should be understood that any number of blister packs 22 can be included in any of the illustrated embodiments. Furthermore, the blister apertures 18, 18' need not have identical shape or dimensions. Similarly, product access apertures 40, 40' of all embodiments can have an irregular shape to provide gates (not illustrated) and or can include additional layers of material to increase the amount of force required to gain access to the product 24 housed in a blister 20 of a blister pack 22. It should also be understood that the inclusion of an adhesive layer may be required for some or all of the described embodiments.

Additionally, while the illustrated embodiments have generally shown the face panels, back panels, and the tab strip inserts to be of substantially identical shape, dimensions, and/or material, it should be understood that the face panels and back panels of all embodiments made according to the present disclosure need not be symmetrical or substantially identical, and need not be made from material having substantially identical properties. Substantial variations in the shape and dimensions of, as well as the materials used to form the face panels, the back panels, and/or the tab strip inserts are possible and are, in fact, contemplated.

While the illustrated embodiments have included packaging blanks made from self-sealing material, it should be understood that glue or other fastening means can be used when assembling the packaging blanks 10, 10' and tab strip inserts 12, 12' into packages 70, 70'.

The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A child resistant product package, comprising:

a face panel including blister apertures and removable tab strip access pads;

a blister pack having blisters each holding a product therein, the blister pack being disposed on the face panel such that the blisters are received in the blister apertures respectively to extend through the face panel;

a tab strip insert having removable tab strips each including a grasping region and a product access prevention region, the tab strip insert being disposed on the blister pack such that the grasping regions of the tab strips are substantially aligned with the tab strip access pads of the face panel respectively and such that the product access prevention regions of the tab strips are substantially aligned with the blisters of the blister pack respectively; and a back panel including product access apertures and removable tab strip grasping pads, the back panel being disposed on the tab strip insert such that the product access apertures are substantially aligned with the product access prevention regions of the tabs strips respectively and such that the tab strip grasping pads are substantially aligned with the grasping regions of the tabs strips respectively, wherein the face panel and the back panel are fastened together such that the face panel and the back panel collectively form a housing for the tab strip insert and the blister package, wherein each of the tab strips is joined to a respective one of the tab strip access pads and a respective one of the tab strip grasping pads whereby the tab strips may be removed from the tab strip insert one at a time when the respective one of the tab strip access pads and the respective one of the tab strip grasping pads are removed from the face panel and the back panel respectively, and wherein the tab strip access pads are disposed in a row, the face panel further including a bending panel portion extending alongside the row of the tab strip access pads, each of the tab strip access pads being separated from the bending panel portion by a cut line, the cut lines defining end edges of the tab strip access pads respectively, the bending panel portion being connected to the face panel along a bending line for bending movement about the bending line with respect to the face panel, and the bending line is interrupted by the tab strip access pads so that the end edges of the tab strip access pads are exposed for easy access thereto upon bending movement of the bending panel portion without removal of the bending panel portion.

2. The child resistant product package of claim 1, wherein the cut line is curved such that the each of the tab strip access pads extends into the bending panel portion.

3. The child resistant product package of claim 2, wherein the cut lines of the tab strip access pads are interconnected by the bending line so that the cut lines and the bending line form a continuous single line.

4. The child resistant product package of claim 1, wherein the cut line of the each of the tab strip access pads is configured such that the end edges of the tab strip access pads protrude beyond the bending line upon bending of the bending panel portion about the bending line.

5. The child resistant product package of claim 4, wherein the cut lines of the tab strip access pads are interconnected by the bending line so that the cut lines and the bending line form a continuous single line.

6. A packaging blank comprising:

a first panel comprising blister apertures for receiving blisters of one or more blister packs and removable tab strip access pads; and a second panel comprising product access apertures and removable tab strip grasping pads, wherein the tab strip access pads are disposed in a row, the first panel further including a bending panel portion extending alongside the row of the tab strip access pads, each of the tab strip access pads being separated from the bending panel portion by a cut line, the cut lines defining end edges of the tab strip access pads respectively, the bending panel portion being connected to the first panel along a bending line for bending movement about the bending line with respect to the first panel, and the bending line is interrupted by the tab strip access pads so that the end edges of the tab strip access pads are exposed for easy access thereto upon bending movement of the bending panel portion without removal of the bending panel portion.

7. The packaging blank of claim 6, wherein the cut line is curved such that the each of the tab strip access pads extends into the bending panel portion.

8. The packaging blank of claim 7, wherein the cut lines of the tab strip access pads are interconnected by the bending line so that the cut lines and the bending line form a continuous single line.

9. The packaging blank of claim 6, wherein the cut line of the each of the tab strip access pads is configured such that the end edges of the tab strip access pads protrude beyond the bending line upon bending of the bending panel portion about the bending line.

10. The packaging blank of claim 9, wherein the cut lines of the tab strip access pads are interconnected by the bending line so that the cut lines and the bending line form a continuous single line.

* * * * *